United States Patent [19]

Huther et al.

[11] Patent Number: 4,728,359

[45] Date of Patent: Mar. 1, 1988

[54] METHOD OF PRODUCING A DISPERSION-HARDENED METAL ALLOY

[75] Inventors: Werner Huther, Karlsfeld; Wolfgang Betz, Gauting; Gerhard Andrees, Munich, all of Fed. Rep. of Germany

[73] Assignee: Motoren- und Turbinen-Union Muchen GmbH, Munich, Fed. Rep. of Germany

[21] Appl. No.: 926,956

[22] Filed: Oct. 4, 1986

[30] Foreign Application Priority Data

Nov. 13, 1985 [DE] Fed. Rep. of Germany ..... 3540225

[51] Int. Cl.[4] ..... B22F 3/12; B22F 5/00

[52] U.S. Cl. ..... 75/0.5 A

[58] Field of Search ..... 75/0.5 A, 0.5 AA, 0.5 C

[56] References Cited

U.S. PATENT DOCUMENTS 3,501,287 3/1970 Lever ..... 75/0.5 A 3,617,253 11/1971 Amiet ..... 75/0.5 A

*Primary Examiner*—Peter D. Rosenberg

*Attorney, Agent, or Firm*—Roberts, Spiecens & Cohen

[57] ABSTRACT

A method of producing a dispersion-hardened metal alloy in which oxide particles are distributed uniformly in the metal matrix. The oxide particles, in finely divided form, are added to a solution of the metal along with a deglomerating agent so as to be dispersed in the solution as a colloid. The colloid suspension is then atomized and reduced to form a powder of the alloy with the oxide particles uniformly dispersed therein.

12 Claims, No Drawings

METHOD OF PRODUCING A DISPERSION-HARDENED METAL ALLOY

FIELD OF THE INVENTION

The present invention relates to a method of producing dispersion-hardened metal alloys, particularly for high-temperature structural parts of complicated shape, in which particles of a second phase are integrated into a metallic matrix by means of a colloidal suspension.

BACKGROUND

It is known that, by a uniform, fine distribution of hard particles, and particularly oxidic particles, in metallic alloys, the resistance of the alloys to deformation can be considerably increased, particularly for use in structural parts operating at high temperatures. A survey of the prior art has been published in "Materials Engineering" February 1982, pages 34–39.

The main problem in the production of such alloys resides in providing a suitable distribution of the hard particles within the metallic matrix. The distance between the particles must be sufficiently small and uniform and the percentage by volume of the hard particles must be limited.

The following known procedure is employed for introducing the hard particles into the metal matrix.

A mechanical alloying of the oxide particles and the alloy is effected by grinding the oxide particles with the alloy so that a continuous fusing takes place and granules containing the oxide particles and the alloy are produced. The granules are reduced to powder form in a high-energy mill, ball mill, attritor or the like. The powder contains the oxide particles in the desired degree of fineness and distribution. This method, however, is very difficult to carry out and does not provide sufficient homogeneity and reproducibility.

SUMMARY OF THE INVENTION

An object of the present invention is to provide a method of producing dispersion-hardened metal alloys which, in simple manner, yields homogeneous powders and the desired particle distribution in the matrix, and thus to structural parts capable of resisting high temperatures.

This object is achieved by the method comprising: forming a solution of a metal alloy; adding oxide particles which are not reactive with the alloy into said solution, adding a deglomerating agent to said solution so that the particles are suspended therein and form a resultant colloidal solution, atomizing said colloidal solution to form atomized particles, removing liquid solvent from the atomized particles and; reducing said atomized particles to produce metal powder in which the oxide is dispersed in the alloy matrix.

The essential advantage of the invention resides in the fact that one obtains a metallic powder with inclusion of oxide particles which has reproducible properties, particularly with respect to uniformity of the distribution of the oxide particles and thus of dispersion hardness. The metal powder obtained in this manner can be formed into compact shaped bodies by known methods of powder metallurgy.

DETAILED DESCRIPTION OF PREFERRED EMBODIMENTS

The invention will be described with reference to the example which follows hereafter in which preferred embodiments of the method are set forth.

EXAMPLE

A solution of a metal alloy is formed by dissolving the metal alloy in hydrochloric acid. The metal alloy is intended to form the matrix of a metallic powder suitable for the production of a dispersion-hardened metal alloy. The metal alloy is a nickel chromium alloy in which the nickel and chromium are in a ratio of 80:20. Other suitable elements which can be included in the nickel chromium alloy are cobalt, aluminum and titanium.

Oxide particles of $Y_2O_3$ or $ThO_2$ of a size of between about 0.01 $\mu$m to about 0.1 $\mu$m are admixed in the solution of the metal alloy. The particles are added to the solution in an amount such that the particles represent up to 75% by volume of the metal alloy.

In order to prevent agglomeration of the oxide particles in the solution, the particles are separated by adsorption of similarly charged molecules, i.e. electrically charged particles of the same polarity, and held in suspension in the solution. For this purpose, deglomerating agents such as trisodium orthophosphate or aluminum nitrate are added to the solution.

The colloidal solution or slip thus produced is then atomized in a trickle tower and is either directly transferred into a reaction chamber or is first dried and converted in another reaction vessel into metal powder with oxide inclusions dispersed uniformly therein.

The metal powder obtained in this manner can then be worked by known methods of powder metallurgy to form compact bodies of desired shape, for instance, by injection molding, extrusion, extrusion molding, sintering, cold isostatic pressing or hot isostatic pressing. The selection of the method of compacting depends, in particular, on the purpose of use of the final product, namely as a high-temperature structural part. The method determines the shape and size of the final product and provides the desired mechanical and other properties as well as the desired density and surface finish.

Modifications of the disclosed method can be effected without departing from the scope of the invention, provided that the same properties of the powder or the structural parts are obtained and the method of particle separation in the colloidal solution is employed.

The invention is also not limited to the metal alloy disclosed in the Example and other materials, particularly other nickel base alloys or super alloys, can form the metal matrix. Other elements, as mentioned above, can be employed in the alloy. The solvents for the metallic alloys, the construction of the atomizing equipment and its operating parameters as well as the powder reduction of the atomized particles into metal are known per se.

The alloy produced in accordance with the invention is particularly suitable for use in motor and turbine construction, for instance for airplane turbine blades.

What is claimed is:

1. A method of producing a metal powder suitable for the production of a dispersion-hardened metal alloy, the metal powder having a dispersed phase of metal oxide in a metal alloy, said method comprising:

forming a liquid solution in which a metal alloy is dissolved;

adding to said liquid solution first particles which are not reactive with said metal alloy and which are also not reactive with said solution, adding a deglomerating agent to said solution so that the first particles are suspended therein and form a resultant colloidal suspension, atomizing said colloidal suspension to form atomized second particles of the dissolved metal alloy and also atomizing said first particles, drying the said first and second atomized particles; and reducing said atomized second particles to produce metal alloy powder particles in which the oxide form of said first particles is uniformly dispersed

2. A method as claimed in claim 1 wherein said metal alloy is an alloy of nickel.

3. A method as claimed in claim 1 wherein said first particles are $Y_2O_3$ or $ThO_2$.

4. A method as claimed in claim 3 wherein said first particles have a size of about 0.01 μm to about 0.1 μm.

5. A method as claimed in claim 4 wherein said first particles are present in an amount of up to 75% by volume of the metal alloy.

6. A method as claimed in claim 1 wherein said deglomerating agent is aluminum phosphate or trisodium phosphate.

7. A method as claimed in claim 1 wherein said metal alloy is an alloy of nickel and chromium in a ratio of 80:20 and said alloy is dissolved in HCl to form said liquid solution.

8. A method as claimed in claim 1 wherein said metal alloy is an alloy of nickel chromium and Co, Al, or Ti.

9. A method as claimed in claim 7 wherein said colloidal suspension is atomized in a trickle tower and the atomized particles are introduced into a reaction chamber where the second particles are reduced to said powder particles.

10. A method as claimed in claim 9 wherein said first and second atomized particles are dried before being introduced into the reaction chamber.

11. A method as claimed in claim 8 wherein said colloidal suspension is atomized in a trickle tower and the atomized first and second particles are introduced into a reaction chamber where the second particles are reduced to said powder particles.

12. A method as claimed in claim 11 wherein said first and second atomized particles are dried before being introduced into the reaction chamber.

* * * * *